US005094784A

United States Patent [19]

Ditter

[11] Patent Number: 5,094,784

[45] Date of Patent: Mar. 10, 1992

[54] DUAL VOLUME CARBURETOR PRIMING SYSTEM

[75] Inventor: Stephen D. Ditter, Fond du Lac, Wis.

[73] Assignee: Tecumseh Products Company, Tecumseh, Mich.

[21] Appl. No.: 654,346

[22] Filed: Feb. 12, 1991

[51] Int. Cl.[5] ..... F02M 1/16

[52] U.S. Cl. ..... 261/35; 261/DIG. 8; 92/43; 123/179.11

[58] Field of Search ..... 261/35, DIG. 8; 123/187.5 R; 92/43

[56] References Cited

U.S. PATENT DOCUMENTS

| | | | |
|---|---|---|---|
| 2,470,288 | 5/1949 | Childs | 92/43 |
| 3,275,305 | 9/1966 | Nutten | 261/35 |
| 3,494,343 | 2/1970 | Nutten | 123/187.5 |
| 3,529,908 | 9/1970 | Smith | 92/43 |
| 4,006,329 | 2/1977 | Hellman et al. | 92/43 |
| 4,197,825 | 4/1980 | Altenbach | 261/DIG. 8 |
| 4,589,386 | 5/1986 | Everts | 123/187.5 |
| 4,655,690 | 4/1987 | Boedecker et al. | 417/53 |
| 4,684,484 | 8/1987 | Guntly | 261/DIG. 8 |
| 4,926,808 | 5/1990 | Kandler | 123/187.5 |

FOREIGN PATENT DOCUMENTS

| | | |
|---|---|---|
| 131869 | 7/1978 | German Democratic Rep. . |
| 59-54758 | 3/1984 | Japan . |
| 64-63640 | 3/1989 | Japan . |
| 2056568 | 7/1979 | United Kingdom . |

*Primary Examiner*—Tim Miles
*Attorney, Agent, or Firm*—Baker & Daniels

[57] ABSTRACT

A carburetor priming system for an internal combustion engine including a flexible bulb which is actuable in a first manner to permit displacement of a one volume of fluid and in a second manner to permit displacement of a second and lesser volume of fluid. Actuation of the bulb in the first manner provides a high volume prime for providing fuel enrichment to a carburetor that has been run dry of fuel. Actuation of the bulb in a second manner provides a normal volume prime.

16 Claims, 2 Drawing Sheets

DUAL VOLUME CARBURETOR PRIMING SYSTEM

BACKGROUND OF THE INVENTION

The present invention relates generally to carburetors for internal combustion engines, and more specifically to carburetor primer mechanisms especially for use in diaphragm-type carburetors.

In small internal combustion engines, and in particular those engines which are started by hand cranking, it is frequently desirable to prime the engine by introducing a fuel-rich mixture into the engine intake system to aid in starting the engine. Such priming arrangements are particularly desirable for use in internal combustion engines of the type which are commonly used in lawnmowers, snow throwers, chain saws and the like, that are likely to be started either infrequently, or in cold weather.

Known priming arrangements are frequently in the form of an operator actuable bulb which, when depressed, displaces a volume of air into the air space above a carburetor float bowl fuel well. This air exerts a pressure on the fuel which forces the fuel upwardly through a conduit into a venturi where it is mixed with air and then drawn into the intake manifold of the engine.

For diaphragm carburetors in which the priming system is the only means for cold start enrichment of the engine, large volume displacement is desirable for purging a fuel system that has been run dry of fuel or never had fuel in it. An example of a typical diaphragm carburetor is disclosed in U.S. Pat. No. 4,684,484, issued to Guntly, assigned to the assignee of the present invention and incorporated herein by reference. In order to provide the volume displacement necessary for purging a completely dry fuel system, large volume priming bulbs can be utilized. However, once the fuel system or carburetor has been initially purged, continued use of the large volume primer may result in overenrichment and engine flooding. Therefore, it is desired to provide a priming system that renders the proper amount of priming fuel to the carburetor under various starting conditions.

SUMMARY OF THE INVENTION

The present invention provides a priming system that permits displacement of a normal volume of fluid and, alternatively, a high volume of fluid for priming a fuel system that has been run dry of fuel. The primer includes a flexible bulb, wherein the volume of fluid displaced is dependent upon the extent of manual depression of the bulb. Two different volumes of fluid may be displaced by the bulb depending upon the manner of actuation of the bulb.

Generally, the invention provides a primer for a carburetor system of an internal combustion engine in which a flexible bulb is actuated in a first manner to permit displacement of a greater volume of fluid than actuation of the bulb in a second manner. More specifically, the present invention provides a primer having a manually depressible bulb and a stop member located within the bulb for limiting depression of the bulb to a first extent in response to actuation of the bulb in a first manner and to a second extent in response to actuation of the bulb in a second manner.

One advantage of the primer of the present invention is that different volumes of fluid may be displaced by the primer depending upon the manner of actuation of the bulb, thereby providing the desired displacement volume under various starting conditions.

Another advantage of the primer of the present invention is that a large volume of fluid displacement is available for cold start enrichment of an engine that is run dry of fuel.

A further advantage of the primer of the present invention is that limiter posts are located within the primer bulb to limit the extent of depression of the bulb, thus providing a predetermined amount of fuel to enter the carburetor and reducing the potential for overenrichment and engine flooding.

The present invention, in one form thereof, provides a carburetor system for an internal combustion engine. The system includes a primer having a flexible bulb which when manually depressed, displaces a volume of fluid. The volume of fluid is dependent upon the extent of manual depression of the bulb. Stop means such as limiter posts are located within the bulb for limiting depression of the bulb to a first extent in response to actuation of the bulb in a first manner and to a second extent in response to actuation of the bulb in a second manner.

The present invention, in one form thereof, provides a carburetor system for an internal combustion engine. The system includes a carburetor having a throat formed therein which defines a fuel/air mixture passage therethrough. The system further includes a fuel supply bowl and a conduit for conveying fuel from the fuel supply bowl to the throat. Further provided is a priming chamber and a priming passage providing communication between the priming chamber and the carburetor. The primer includes a flexible bulb which, when manually depressed, displaces fluid from the priming chamber through the priming passage and into the throat of the carburetor. The volume of fluid displaced is dependent upon the extent of manual depression of the bulb. Limiter posts are located within the bulb for limiting depression of the bulb to a first extent in response to actuation at a first location on the bulb and to a second extent in response to actuation at a second location on the bulb.

DESCRIPTION OF THE PREFERRED EMBODIMENT

Figure 1:
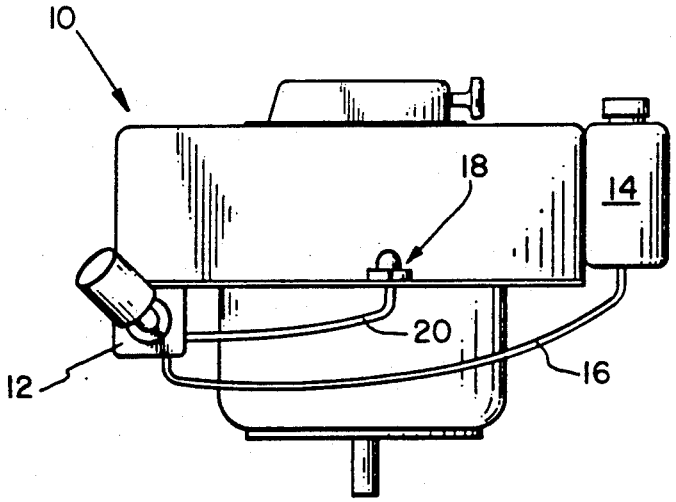
FIG. 1 is a side elevational view of an internal combustion engine, including a primer in accordance with the present invention.

Referring to the drawings, and particularly to FIG. 1, there is shown a small internal combustion engine 10 including a conventional carburetor 12. Liquid fuel is supplied from fuel supply bowl 14 to carburetor 12 through conduit 16. The air-vaporized fuel mixture from carburetor 12 then passes into the intake manifold of the engine.

When engine 10 is cold or inoperative for a period of time, it is desired to supplement the quantity of combustible fuel which is normally delivered to the combustion chamber by providing a priming system to facilitate initial starting operations. The priming system includes a primer 18 for forcing fuel and/or air through tubing 20 and into the carburetor bowl, and then into either the fuel nozzle chamber or the diaphragm chamber in carburetor 12 to force fuel into the throat of carburetor 12.

Figure 2:
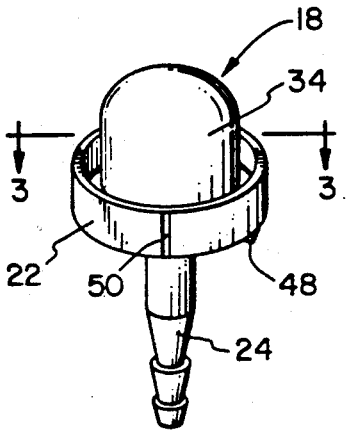
FIG. 2 is an enlarged perspective view of the primer of FIG. 1.
Figure 3:
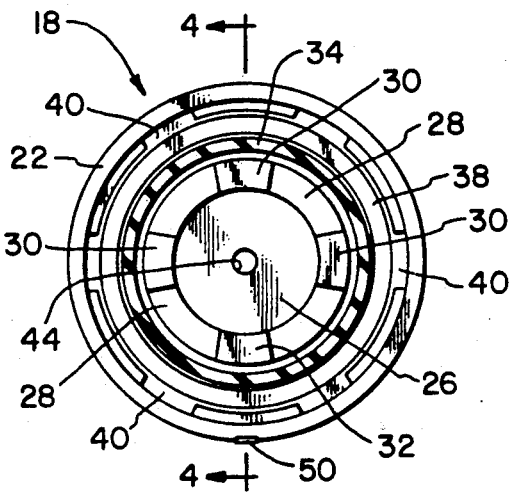
FIG. 3 is an enlarged cross-sectional view of the primer of FIG. 2, taken along line 3—3 in FIG. 2.
Figure 4:
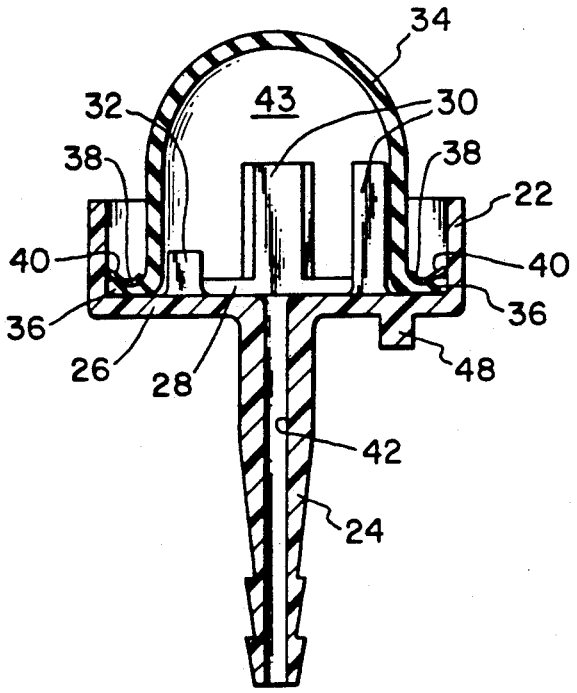
FIG. 4 is a longitudinal sectional view of the primer of FIG. 3, taken along line 4—4 in FIG. 3.

Referring to FIGS. 2–4, primer 18 includes a circular mounting portion 22 integrally formed with a downwardly extending nipple 24. Mounting portion 22 includes a generally circular lower base portion 26 and a concentric raised base portion 28. A plurality of limiter posts 30 are circumferentially secured to raised portion 28. As shown in FIG. 4, a much smaller limiter post 32 is also secured to raised portion 28. FIG. 3 illustrates one possible arrangement of limiter posts 30 and 32 around raised portion 28 in which each post is disposed approximately 90° apart. As best shown in FIG. 4, flexible squeeze bulb 34 includes a flanged portion 36 that is secured within mounting portion 22 by a retaining ring 38. Bulb 34 is generally hollow and is made from a polymer material that is not affected by petrochemical products. Retaining ring 38 includes a plurality of radially extending locking tangs 40 which are canted, as shown in FIG. 4, to permit insertion of ring 38 into mounting portion 22, but to restrict subsequent upward movement of ring 38 thereby securing ring 38 within mounting portion 22.

Figure 5:
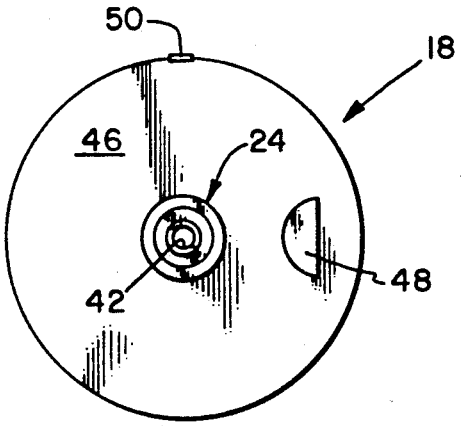
FIG. 5 is an enlarged bottom view of the primer of FIG. 2.

Nipple 24 of primer 18 is secured to flexible tube 20 and includes an axial fluid passage 42 therein for communicating air and/or fuel from interior space 43 of bulb 34, through opening 44 (FIG. 3), into passage 42, and then into tube 20. As best shown in FIGS. 4 and 5, the bottom surface of mounting portion 22 includes an orientation tab 48 to properly orient primer 18 on engine 10.

Figure 7:
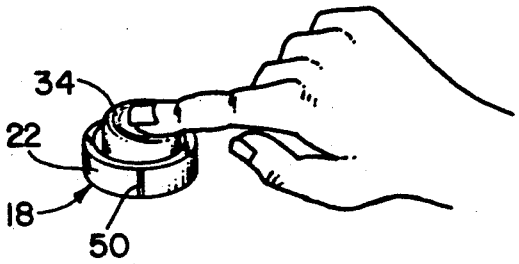
FIG. 7 is the primer of FIG. 6, wherein the primer bulb has been depressed by an operator to generate normal volume priming.

In operation, primer 18 can provide either a high volume prime or a normal volume prime. High volume prime is the volume of priming necessary to sufficiently prime a fuel system that has been run dry of fuel. The volume of the prime is dependent upon the manner in which bulb 34 is actuated and is determined by the spacing and height of posts 30 and 32. A normal volume of prime is solely determined by the height of posts 30. As shown in FIG. 7, normal volume priming is achieved upon depression of the top of bulb 34 until the bulb engages limiter posts 30. The volume of air and/or fuel displaced is forced through tubing 20 and into carburetor 12, thereby forcing a predetermined amount of fuel into the throat of carburetor 12. The volume of normal priming can be varied by varying the height of posts 30.

Figure 6:
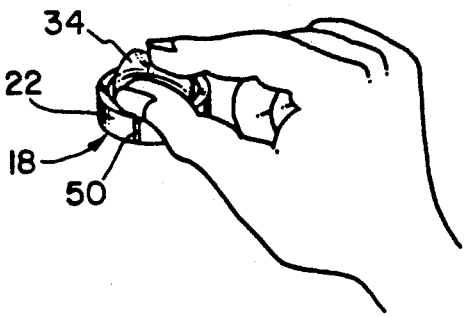
FIG. 6 is a perspective view of the primer according to the present invention, wherein the primer bulb has been depressed by an operator to generate a high volume priming.

In addition to normal priming, primer 18 also provides high volume priming for purging a fuel system which has been run dry of fuel or is new. In order to obtain high volume priming, bulb 34 is actuated as shown in FIG. 6. High volume priming can be accomplished by the use of limiter post 32, which is smaller than limiter posts 30 thereby allowing a larger displacement of bulb 34. The location of post 32 within bulb 34 is externally indicated by a small orientation notch 50 on mounting portion 22. When bulb 34 is depressed on the side indicated by notch 50, a relatively large volume of air and/or fuel is displaced since bulb 34 can be depressed a greater distance before being stopped by posts 30 and 32 due to the short height of post 32. FIG. 6 illustrates the thumb of the operator depressing bulb 34 in this manner. In order to provide further fluid displacement, the top of bulb 34 is also depressed in the same manner as described for normal volume priming. It is the simultaneous depression of bulb 34 at both the top and the side indicated by notch 50 that provides the high volume priming. The high volume prime provides fluid displacement up to 2.7 times that of normal volume priming.

Once the carburetor has been purged with fuel due to the high volume priming, such priming is no longer needed or desired. The operator may then subsequently prime carburetor 12 as shown in FIG. 7 and as previously described.

As an alternative to the use of posts 30 and 32, other means may be used for limiting the displacement of bulb 34. For example, a single circumferential post having a recessed shoulder may be provided so that actuation of the bulb at the shoulder permits the bulb to be displaced a distance sufficient for high volume priming. In addition, any other shape or size of bulb limiting device may be used within bulb 34 which supplies a gap or space to allow greater displacement of the bulb when actuated at such location than if actuated at a second location.

It will be appreciated that the foregoing is presented by way of illustration only, and not by way of any limitation, and that various alternatives and modifications may be made to the illustrated embodiment without departing from the spirit and scope of the invention.

What is claimed is:

1. In a carburetor system for an internal combustion engine, a primer, comprising:

means including a flexible bulb for displacing fluid upon manual depression of said bulb, wherein the volume of fluid displaced is dependent upon the extent of manual depression of said bulb; and stop means within said bulb for limiting depression of said bulb to a first extent in response to actuation of said bulb in a first manner and to a second extent in response to actuation of said bulb in a second manner.

2. The carburetor according to claim 1, wherein actuation of said bulb in said first manner permits displacement of a greater volume of fluid than actuation of said bulb in said second manner.

3. The carburetor according to claim 1, wherein depression of said bulb to said first extent displaces a first volume of fluid and depression of said bulb to said second extent displaces a second volume of fluid, said first volume of fluid being greater than said second volume of fluid.

4. The carburetor according to claim 3, wherein said first volume is at least 1.5 times greater than said second volume.

5. The carburetor according to claim 1, wherein said bulb defines an inner chamber and said stop means comprises at least one upstanding post within said chamber to limit depression of said bulb.

6. The carburetor according to claim 1, wherein said bulb defines an inner chamber and said stop means comprises a plurality of upstanding posts within said chamber to limit depression of said bulb.

7. The carburetor according to claim 6, wherein said bulb includes a top surface and each said post includes an attached bottom end and an unattached top end, wherein the distance between the top surface of said bulb and said top end defines said volume of liquid displaced upon depression of said bulb to said second extent.

8. The carburetor according to claim 6, wherein said posts are arranged in a predetermined circumferential location to define a gap within said chamber between two of said posts, wherein depression of a portion of said bulb immediately covering said gap actuates said bulb in said second manner.

9. In a carburetor system for an internal combustion engine, a primer comprising:

means including a flexible bulb for displacing fluid upon manual depression of said bulb, wherein the volume of fluid displaced is dependent upon the extent of manual depression of said bulb; and stop means within said bulb for limiting depression of said bulb to a first extent in response to actuation at a first location on said bulb and to a second extent in response to actuation at a second location on said bulb.

10. The carburetor according to claim 9, wherein said bulb includes a generally circular mounting end, said stop means being eccentrically located with respect to the center of said mounting end.

11. The carburetor according to claim 9, wherein actuation of said bulb at said first location permits displacement of a greater volume of fluid than actuation of said bulb at said second location.

12. The carburetor according to claim 9, wherein depression of said bulb to said first extent displaces a first volume of fluid and depression of said bulb to said second extent displaces a second volume of fluid, said first volume of fluid being greater than said second volume of fluid.

13. The carburetor according to claim 12, wherein said first volume is at least 1.5 times greater than said second volume.

14. The carburetor according to claim 9, wherein said primer includes a base, said bulb being disposed over said base and secured to said base by a retaining ring.

15. The carburetor according to claim 14, wherein said bulb includes a body portion and a flanged portion extending radially outwardly of said body portion, said retaining ring being secured over said flanged portion.

16. The carburetor according to claim 14, wherein said stop means comprises at least one upwardly extending post integrally formed with said base.

* * * * *